US009824629B2

(12) United States Patent
Nie

(10) Patent No.: US 9,824,629 B2
(45) Date of Patent: Nov. 21, 2017

(54) AMOLED PIXEL DRIVING CIRCUIT AND PIXEL DRIVING METHOD

(71) Applicant: Shenzhen China Star Optoelectronics Technology Co., Ltd., Shenzhen (CN)

(72) Inventor: Chenglei Nie, Shenzhen (CN)

(73) Assignee: SHENZHEN CHINA STAR OPTOELECTRONICS TECHNOLOGY CO., LTD., Shenzhen, Guangdong (CN)

( * ) Notice: Subject to any disclaimer, the term of this patent is extended or adjusted under 35 U.S.C. 154(b) by 168 days.

(21) Appl. No.: 14/761,300

(22) PCT Filed: Apr. 3, 2015

(86) PCT No.: PCT/CN2015/075848

§ 371 (c)(1),
(2) Date: Jul. 15, 2015

(87) PCT Pub. No.: WO2016/145692

PCT Pub. Date: Sep. 22, 2016

(65) Prior Publication Data

US 2016/0307502 A1 Oct. 20, 2016

(30) Foreign Application Priority Data

Mar. 16, 2015 (CN) ..... 2015 1 0115666

(51) Int. Cl.
*G09G 3/32* (2016.01)
*G09G 3/3233* (2016.01)

(52) U.S. Cl.
CPC ... *G09G 3/3233* (2013.01); *G09G 2300/0819* (2013.01); *G09G 2300/0842* (2013.01);
(Continued)

(58) Field of Classification Search
CPC ..... G09G 3/3233; G09G 3/2003; G09G 2300/0819; G09G 2300/0842; G09G 2310/0248; G09G 2320/0233
See application file for complete search history.

(56) References Cited

U.S. PATENT DOCUMENTS

2015/0339974 A1* 11/2015 Wu ..... G09G 3/3233 345/690

FOREIGN PATENT DOCUMENTS

CN 103236237 A 8/2013

* cited by examiner

*Primary Examiner* — Benjamin C Lee
*Assistant Examiner* — Robert Michaud
(74) *Attorney, Agent, or Firm* — Leong C. Lei

(57) ABSTRACT

The present invention provides an AMOLED pixel driving circuit and a pixel driving method. The AMOLED pixel driving circuit utilizes the 5T1C structure and comprises a first, a second, a third, a fourth and a fifth thin film transistors (M1, M2, M3, M4 and M5), a capacitor (C1) and an organic light emitting diode (D1). The AMOLED pixel driving circuit directly acquires a threshold voltage of the fourth thin film transistor (M4), i.e. the drive thin film transistor to implement threshold voltage compensation; by inputting the data signal (Data) to the source of the fourth thin film transistor (M4), i.e. the drive thin film transistor, the circuit reads the data signal (Data) at the same time while acquiring the threshold voltage of the drive thin film transistor to promote the working efficiency of the circuit; by setting one end of the capacitor (C1) to be coupled to a gate of the fourth thin film transistor (M4), i.e. the drive thin film transistor, and the other end to be coupled to the earth (GND), the signal input of the capacitor end can be reduced to simplify the required input signal.

13 Claims, 11 Drawing Sheets

(52) U.S. Cl.
CPC ..... *G09G 2300/0861* (2013.01); *G09G 2310/0283* (2013.01); *G09G 2320/0233* (2013.01); *G09G 2320/045* (2013.01)

AMOLED PIXEL DRIVING CIRCUIT AND PIXEL DRIVING METHOD

FIELD OF THE INVENTION

The present invention relates to a display technology field, and more particularly to an AMOLED pixel driving circuit and a pixel driving method.

BACKGROUND OF THE INVENTION

The Organic Light Emitting Display (OLED) possesses many outstanding properties of self-illumination, low driving voltage, high luminescence efficiency, short response time, high clarity and contrast, near 180° view angle, wide range of working temperature, applicability of flexible display and large scale full color display. The OLED is considered as the most potential display device.

The OLED can be categorized into two major types according to the driving ways, which are the Passive Matrix OLED (PMOLED) and the Active Matrix OLED (AMOLED), i.e. two types of the direct addressing and the Thin Film Transistor matrix addressing. The AMOLED comprises pixels arranged in array and belongs to active display type, which has high lighting efficiency and is generally utilized for the large scale display devices of high resolution.

The AMOLED is a current driving element. When the electrical current flows through the organic light emitting diode, the organic light emitting diode emits light, and the brightness is determined according to the current flowing through the organic light emitting diode itself. Generally, an AMOLED pixel driving circuit comprises two thin film transistors (TFT) and one capacitor, i.e. a 2T1C pixel driving circuit. The thin film transistor employed for controlling the writing of the data signal (Data) is a Switching TFT, and the thin film transistor employed for controlling the current flowing through the OLED is a Driving TFT. Therefore, the importance of the threshold voltage ($V_{th}$) of the driving TFT is obviously significant. Both the positive and negative drifts of the threshold voltage will make different current flowing through the OLED under the same data signal and the OLED will have different brightness.

At present, both the thin film transistors manufactured by Low Temperature Poly-silicon (LTPS) and oxide semiconductor will have the phenomenon of threshold voltage drift during usage. For example, the factors of the light irradiation, source-drain voltage stress and etc. can cause the threshold voltage drift and result in that the current flowing through the OLED is not consistent with the desired current. The panel brightness cannot satisfy the requirements, therefore. In the general 2T1C pixel driving circuit, the threshold voltage drift of the Driving TFT cannot be improved by adjustment. Thus, new thin film transistors or new signals are required to weaken or even eliminate the influence caused by the threshold voltage drift.

Please refer to FIG. 1, which shows an AMOLED pixel driving circuit utilizing a 5T1C structure according to prior art, comprising: a first thin film transistor T1, a second thin film transistor T2, a third thin film transistor T3, a fourth thin film transistor T4, a fifth thin film transistor T5, a capacitor Cst and an organic light emitting diode OLED. A gate of the first thin film transistor T1 is electrically coupled to one end of the capacitor Cst and a drain of the second thin film transistor T2, and a source is electrically coupled to a drain of the third thin film transistor T3, and a drain is electrically coupled to a drain of the fourth thin film transistor T4 and a source of the fifth thin film transistor T5; a gate of the second thin film transistor T2 is electrically coupled to a first scan control signal N1, and a source is electrically coupled to the drain of the third thin film transistor T3 and a drain is electrically coupled to the gate of the first thin film transistor T1 and the one end of the capacitor Cst; a gate of the third thin film transistor T3 is electrically coupled to a light emitting control signal EM, and a source is electrically coupled to a power supply positive voltage SR1/OVDD and a drain is electrically coupled to the source of the second thin film transistor T2 and the source of the first thin film transistor T1; a gate of the fourth thin film transistor T4 is electrically coupled to the first scan control signal N1, and a source is electrically coupled to a data signal DIN/$V_{Data}$, and a drain is electrically coupled to the drain of the first thin film transistor T1 and a source of the fifth thin film transistor T5; a gate of the fifth thin film transistor T5 is electrically coupled to the light emitting control signal EM, and a source is electrically coupled to the drain of the first thin film transistor T1 and the drain of the fourth thin film transistor T4, and a drain is electrically coupled to an anode of the organic light emitting diode OLED; the one end of the capacitor Cst is electrically coupled to the gate of the first thin film transistor T1 and the drain of the second thin film transistor T2, and the other end is electrically coupled to a second scan control signal N2; the anode of the organic light emitting diode OLED is electrically coupled to the drain of the fifth thin film transistor T5, and a cathode is electrically coupled to a power supply negative voltage SR2/OVSS. In the present 5T1C AMOLED pixel driving circuit, the other end of the capacitor Cst needs the second scan control signal N2 to be inputted solo for controlling. Consequently, the input signal is complicated. The manufacture cost of the panel is higher and the stability of the circuit is worse.

SUMMARY OF THE INVENTION

An objective of the present invention is to provide an AMOLED pixel driving circuit capable of compensating the threshold voltage of the drive thin film transistor and reducing the change of the current flowing through the organic light emitting diode along with the threshold voltage drift to enormously promote the stability of the current and make the panel brightness even. Moreover, the signal input of the capacitor end can be reduced to simplify the input signal for lowering the manufacture cost of the panel and raising the working efficiency of the circuit.

Another objective of the present invention is to provide an AMOLED pixel driving method capable of compensating the threshold voltage of the drive thin film transistor and reducing the change of the current flowing through the organic light emitting diode along with the threshold voltage drift to enormously promote the stability of the current and make the panel brightness even. Moreover, the signal input of the capacitor end can be reduced to simplify the input signal for lowering the manufacture cost of the panel and raising the working efficiency of the circuit.

For realizing the aforesaid objectives, the present invention provides an AMOLED pixel driving circuit, comprising: a first thin film transistor, a second thin film transistor, a third thin film transistor, a fourth thin film transistor, a fifth thin film transistor, a capacitor and an organic light emitting diode;

a gate of the first thin film transistor is electrically coupled to a second reverse scan control signal, and a drain is electrically coupled to a power supply voltage, and a source is electrically coupled to a first node;

a gate of the second thin film transistor is electrically coupled to a first scan control signal, and a drain is electrically coupled to a second node, and a source is electrically coupled to the first node;

a gate of the third thin film transistor is electrically coupled to a first reverse scan control signal, and a drain is electrically coupled to an anode of the organic light emitting diode and a source is electrically coupled to a third node;

a gate of the fourth thin film transistor is electrically coupled to a second node and one end of the capacitor, and a drain is electrically coupled to the first node, and a source is electrically coupled to the third node and a drain of the fifth thin film transistor;

a gate of the fifth thin film transistor is electrically coupled to a second scan control signal, and a drain is electrically coupled to the third node and the source of the fourth thin film transistor, and a source is electrically coupled to a data signal;

one end of the capacitor is electrically coupled to the second node and the gate of the fourth thin film transistor, and the other end is electrically coupled to an earth;

the anode of the organic light emitting diode is electrically coupled to the drain of the third thin film transistor, and a cathode is electrically coupled to the earth;

the fourth thin film transistor is a drive thin film transistor; the AMOLED pixel driving circuit directly acquires a threshold voltage of the fourth thin film transistor to implement threshold voltage compensation, and acquirement of the threshold voltage and data signal read are accomplished at the same time.

All of the first thin film transistor, the second thin film transistor, the third thin film transistor, the fourth thin film transistor and the fifth thin film transistor are Low Temperature Poly-silicon thin film transistors, oxide semiconductor thin film transistors or amorphous silicon thin film transistors.

All of the first scan control signal, the first reverse scan control signal, the second scan control signal and the second reverse scan control signal are provided by an external sequence controller.

The first scan control signal, the first reverse scan control signal, the second scan control signal, the second reverse scan control signal and the data signal are combined with one another, and correspond to an initialization stage, a threshold voltage programming stage and a drive stage one after another;

in the threshold voltage programming stage, processes of the acquirement of the threshold voltage and the data signal read are accomplished at the same time.

In the initialization stage, the first scan control signal provides high voltage level, and the first reverse scan control signal provides low voltage level, and the second scan control signal provides low voltage level, and the second reverse scan control signal provides high voltage level, and the data signal provides low voltage level;

in the threshold voltage programming stage, the first scan control signal provides high voltage level, and the first reverse scan control signal provides low voltage level, and the second scan control signal provides high voltage level, and the second reverse scan control signal provides low voltage level, and the data signal provides high voltage level;

in the drive stage, the first scan control signal provides low voltage level, and the first reverse scan control signal provides high voltage level, and the second scan control signal provides low voltage level, and the second reverse scan control signal provides high voltage level, and the data signal provides low voltage level.

Or, in the initialization stage, the first scan control signal provides high voltage level, and the first reverse scan control signal provides high voltage level, and the second scan control signal provides low voltage level, and the second reverse scan control signal provides high voltage level, and the data signal provides low voltage level;

in the threshold voltage programming stage, the first scan control signal provides high voltage level, and the first reverse scan control signal provides low voltage level, and the second scan control signal provides high voltage level, and the second reverse scan control signal provides low voltage level, and the data signal provides high voltage level;

in the drive stage, the first scan control signal provides low voltage level, and the first reverse scan control signal provides high voltage level, and the second scan control signal provides low voltage level, and the second reverse scan control signal provides high voltage level, and the data signal provides low voltage level.

The first reverse scan control signal and the second reverse scan control signal are the same.

The present invention further provides an AMOLED pixel driving circuit, comprising: a first thin film transistor, a third thin film transistor, a fourth thin film transistor, a fifth thin film transistor, a capacitor and an organic light emitting diode;

a gate of the first thin film transistor is electrically coupled to a second reverse scan control signal, and a drain is electrically coupled to a power supply voltage, and a source is electrically coupled to a first node;

a gate of the second thin film transistor is electrically coupled to a first scan control signal, and a drain is electrically coupled to a second node, and a source is electrically coupled to the first node;

a gate of the third thin film transistor is electrically coupled to a first reverse scan control signal, and a drain is electrically coupled to an anode of the organic light emitting diode and a source is electrically coupled to a third node;

a gate of the fourth thin film transistor is electrically coupled to a second node and one end of the capacitor, and a drain is electrically coupled to the first node, and a source is electrically coupled to the third node and a drain of the fifth thin film transistor;

a gate of the fifth thin film transistor is electrically coupled to a second scan control signal, and a drain is electrically coupled to the third node and the source of the fourth thin film transistor, and a source is electrically coupled to a data signal;

one end of the capacitor is electrically coupled to the second node and the gate of the fourth thin film transistor, and the other end is electrically coupled to an earth;

the anode of the organic light emitting diode is electrically coupled to the drain of the third thin film transistor, and a cathode is electrically coupled to the earth;

the fourth thin film transistor is a drive thin film transistor; the AMOLED pixel driving circuit directly acquires a threshold voltage of the fourth thin film transistor to implement threshold voltage compensation, and acquirement of the threshold voltage and data signal read are accomplished at the same time;

wherein all of the first thin film transistor, the second thin film transistor, the third thin film transistor, the fourth thin film transistor and the fifth thin film transistor are Low Temperature Poly-silicon thin film transistors, oxide semiconductor thin film transistors or amorphous silicon thin film transistors;

wherein all of the first scan control signal, the first reverse scan control signal, the second scan control signal and the second reverse scan control signal are provided by an external sequence controller.

The present invention further provides an AMOLED pixel driving method, comprising steps of:

step 1, providing an AMOLED pixel driving circuit;

the AMOLED pixel driving circuit comprises: a first thin film transistor, a second thin film transistor, a third thin film transistor, a fourth thin film transistor, a fifth thin film transistor, a capacitor and an organic light emitting diode;

a gate of the first thin film transistor is electrically coupled to a second reverse scan control signal, and a drain is electrically coupled to a power supply voltage, and a source is electrically coupled to a first node;

a gate of the second thin film transistor is electrically coupled to a first scan control signal, and a drain is electrically coupled to a second node, and a source is electrically coupled to the first node;

a gate of the third thin film transistor is electrically coupled to a first reverse scan control signal, and a drain is electrically coupled to an anode of the organic light emitting diode and a source is electrically coupled to a third node;

a gate of the fourth thin film transistor is electrically coupled to a second node and one end of the capacitor, and a drain is electrically coupled to the first node, and a source is electrically coupled to the third node and a drain of the fifth thin film transistor;

a gate of the fifth thin film transistor is electrically coupled to a second scan control signal, and a drain is electrically coupled to the third node and the source of the fourth thin film transistor, and a source is electrically coupled to a data signal;

one end of the capacitor is electrically coupled to the second node and the gate of the fourth thin film transistor, and the other end is electrically coupled to an earth;

the anode of the organic light emitting diode is electrically coupled to the drain of the third thin film transistor, and a cathode is electrically coupled to the earth;

the fourth thin film transistor is a drive thin film transistor;

step 2, entering an initialization stage;

the first scan control signal provides high voltage level, and the second scan control signal provides low voltage level, and the second reverse scan control signal provides high voltage level, and the data signal provides low voltage level; the first, the second thin film transistors are activated, and the fifth thin film transistor is deactivated, and the gate of the fourth thin film transistor and the power supply voltage are shorted to accomplish the initialization;

step 3, entering a threshold voltage programming stage;

the first scan control signal provides high voltage level, and the first reverse scan control signal provides low voltage level, and the second scan control signal provides high voltage level, and the second reverse scan control signal provides low voltage level, and the data signal provides high voltage level; the first, the third thin film transistors are deactivated, and the fifth, the second thin film transistors are activated, and the gate and the source of the fourth thin film transistor starts to discharge, and a gate voltage of the fourth thin film transistor is discharged from the power supply voltage to $V_{Data}+V_{th}$, wherein the $V_{Data}$ is a voltage provided by the data signal, and $V_{th}$ is a threshold voltage of the fourth thin film transistor, and the threshold voltage of the fourth thin film transistor and the voltage provided by the data signal are stored in the capacitor, and direct acquirement of the threshold voltage of the fourth thin film transistor and read of the data signal are accomplished at the same time;

step 4, entering a drive stage;

the first scan control signal provides low voltage level, and the first reverse scan control signal provides high voltage level, and the second scan control signal provides low voltage level, and the second reverse scan control signal provides high voltage level, and the data signal provides low voltage level; the fifth, the second thin film transistors are deactivated, and the first, the third thin film transistors are activated, and the capacitor maintains the gate voltage of the fourth thin film transistor at $V_{Data}+V_{th}$, and the organic light emitting diode emits light, and by directly acquiring the threshold voltage of the fourth thin film transistor to implement threshold voltage compensation, and a current flowing through the organic light emitting diode is irrelevant with the threshold voltage of the fourth thin film transistor.

In the step 2, the first reverse scan control signal provides low voltage level, and the third thin film transistor is deactivated.

In the step 2, the first reverse scan control signal provides high voltage level, and the third thin film transistor is activated; the first reverse scan control signal and the second reverse scan control signal are the same.

The benefits of the present invention are: the present invention provides an AMOLED pixel driving circuit and a pixel driving method. By directly acquiring a threshold voltage of the fourth thin film transistor, i.e. the drive thin film transistor to implement threshold voltage compensation and reducing the change of the current flowing through the organic light emitting diode along with the threshold voltage drift to enormously promote the stability of the current and make the panel brightness even; by inputting the data signal to the source of the fourth thin film transistor, i.e. the drive thin film transistor, the circuit reads the data signal at the same time while acquiring the threshold voltage of the drive thin film transistor to combine the procedures of the acquirement of the threshold voltage and the read of the data signal as one to promote the working efficiency of the circuit; by setting one end of the capacitor to be coupled to a gate of the fourth thin film transistor, i.e. the drive thin film transistor, and the other end to be coupled to the earth, the signal input of the capacitor end can be reduced to simplify the required input signal. The manufacture cost of the panel can be lowered and the stability of the circuit can be raised in advance.

In order to better understand the characteristics and technical aspect of the invention, please refer to the following detailed description of the present invention is concerned with the diagrams, however, provide reference to the accompanying drawings and description only and is not intended to be limiting of the invention.

BRIEF DESCRIPTION OF THE DRAWINGS

The technical solution and the beneficial effects of the present invention are best understood from the following detailed description with reference to the accompanying figures and embodiments.

In drawings.

DETAILED DESCRIPTION OF PREFERRED EMBODIMENTS

For better explaining the technical solution and the effect of the present invention, the present invention will be further described in detail with the accompanying drawings and the specific embodiments.

Figure 1:
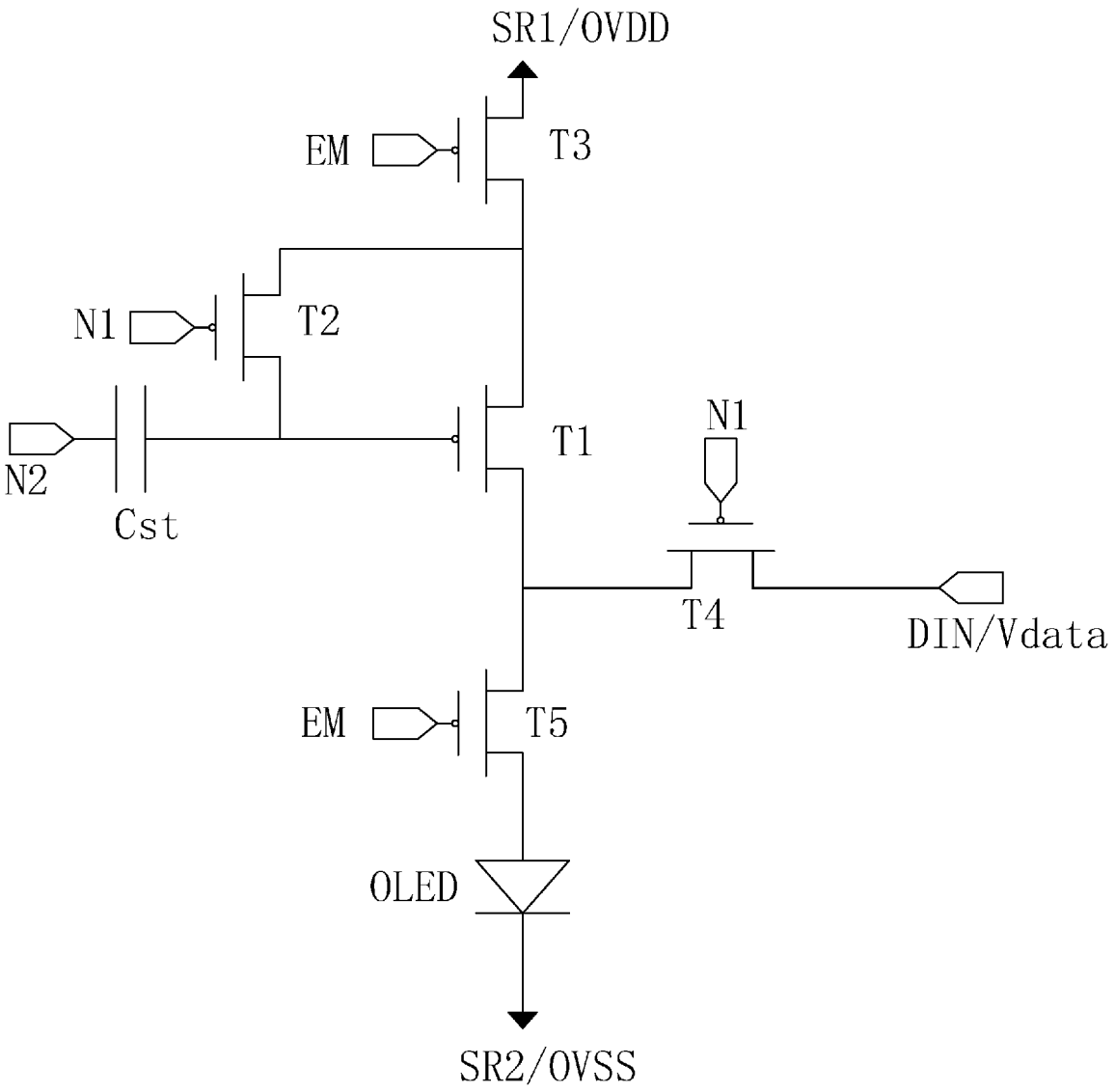
FIG. 1 is a circuit diagram of an AMOLED pixel driving circuit utilizing the 5T1C structure according to prior art.
Figure 2:
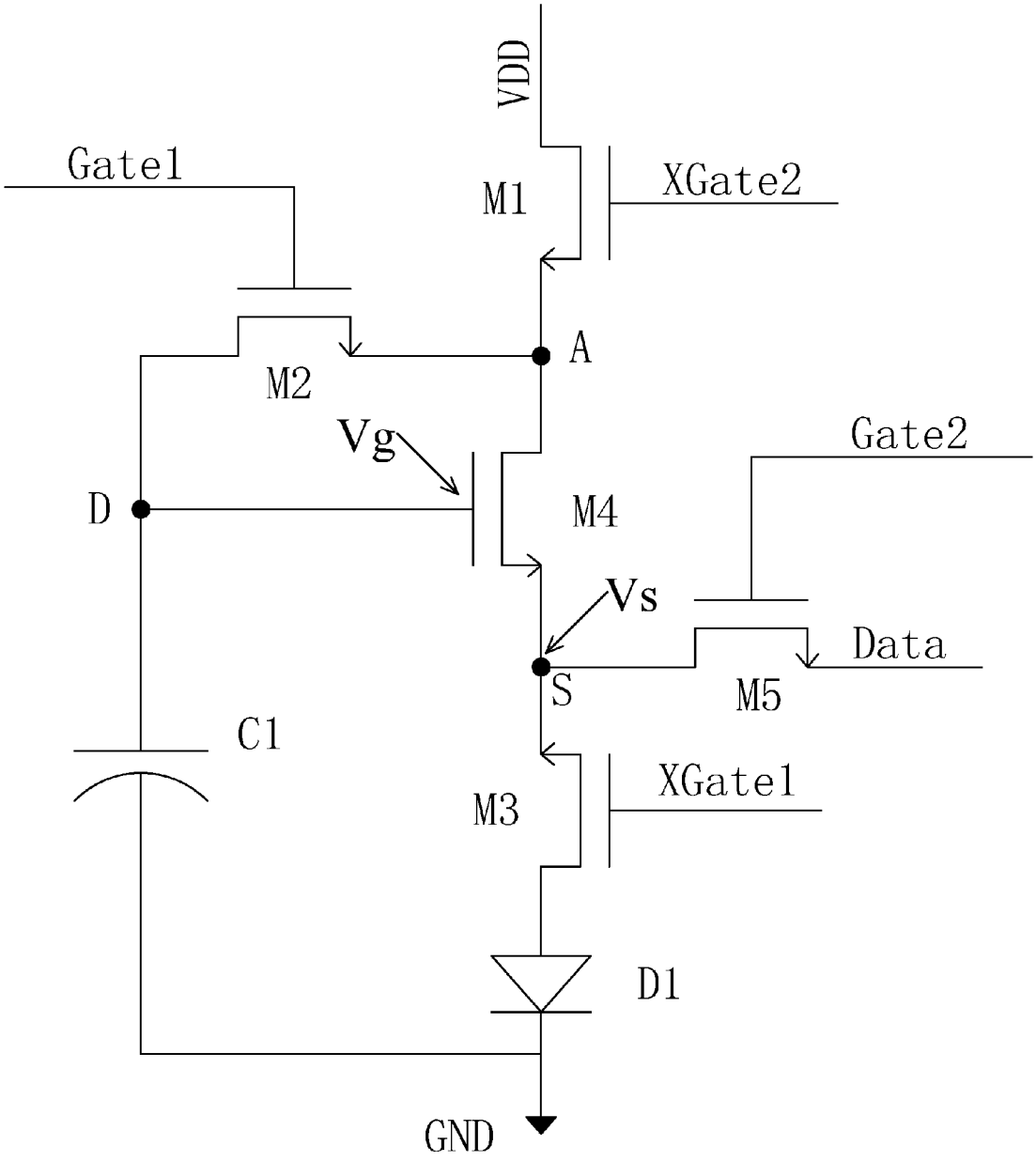
FIG. 2 is a circuit diagram of an AMOLED pixel driving circuit according to present invention.

Please refer to FIG. 2. The present invention first provides an AMOLED pixel driving circuit, comprising a first thin film transistor M1, a second thin film transistor M2, a third thin film transistor M3, a fourth thin film transistor M4, a fifth thin film transistor M5, a capacitor C1 and an organic light emitting light diode D1.

A gate of the first thin film transistor M1 is electrically coupled to a second reverse scan control signal XGate2, and a drain is electrically coupled to a power supply voltage VDD, and a source is electrically coupled to a first node A; a gate of the second thin film transistor M2 is electrically coupled to a first scan control signal Gate1, and a drain is electrically coupled to a second node D, and a source is electrically coupled to the first node A; a gate of the third thin film transistor M3 is electrically coupled to a first reverse scan control signal XGate1, and a drain is electrically coupled to an anode of the organic light emitting diode D1 and a source is electrically coupled to a third node S; a gate of the fourth thin film transistor M4 is electrically coupled to a second node D and one end of the capacitor C1, and a drain is electrically coupled to the first node A, and a source is electrically coupled to the third node S and a drain of the fifth thin film transistor M5; a gate of the fifth thin film transistor M5 is electrically coupled to a second scan control signal Gate2, and a drain is electrically coupled to the third node S and the source of the fourth thin film transistor M4, and a source is electrically coupled to a data signal Data; one end of the capacitor C1 is electrically coupled to the second node D and the gate of the fourth thin film transistor M4, and the other end is electrically coupled to an earth GND; the anode of the organic light emitting diode D1 is electrically coupled to the drain of the third thin film transistor M3, and a cathode is electrically coupled to the earth GND.

Specifically, the fourth thin film transistor M4 is a drive thin film transistor, employed for driving the organic light emitting diode D1 to emit light. All of the first thin film transistor M1, the second thin film transistor M2, the third thin film transistor M3, the fourth thin film transistor M4 and the fifth thin film transistor M5 are Low Temperature Poly-silicon thin film transistors, oxide semiconductor thin film transistors or amorphous silicon thin film transistors.

All of the first scan control signal Gate1, the first reverse scan control signal XGate1, the second scan control signal Gate2 and the second reverse scan control signal XGate2 are provided by an external sequence controller. The first scan control signal Gate1, the first reverse scan control signal XGate1, the second scan control signal Gate2, the second reverse scan control signal XGate2 and the data signal Data are combined with one another, and correspond to an initialization stage Initial, a threshold voltage programming stage Program and a drive stage Driving one after another.

Figure 3:
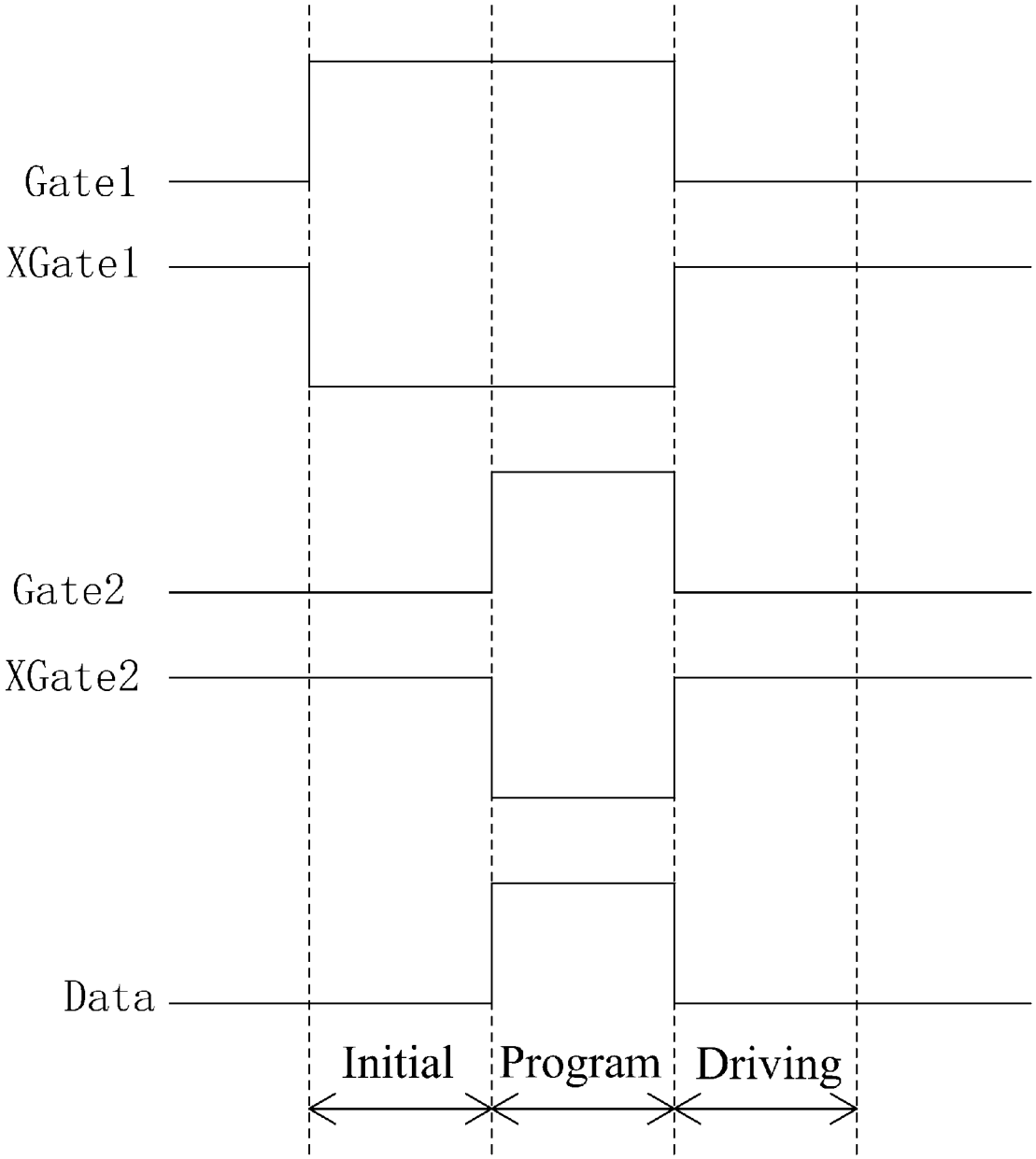
FIG. 3 is a first sequence diagram of an AMOLED pixel driving circuit according to the present invention.
Figure 5:
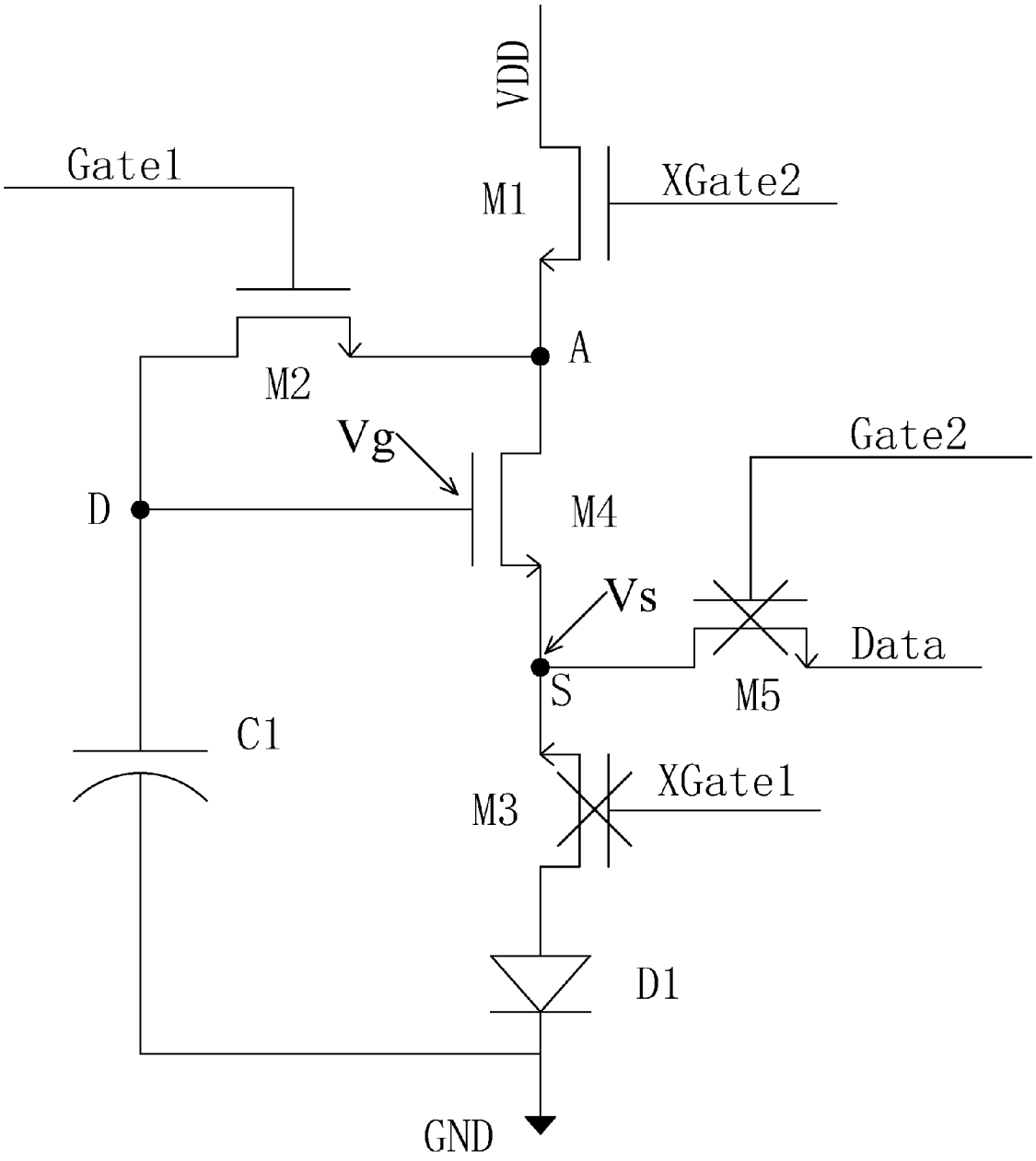
FIG. 5 is a diagram of the step 2 of an AMOLED pixel driving method according to the present invention in accordance with the first sequence.

Furthermore, as shown in FIG. 3, the first sequence diagram of an AMOLED pixel driving circuit according to the present invention:

in the initialization stage Initial, the first scan control signal Gate 1 provides high voltage level, and the first reverse scan control signal XGate1 provides low voltage level, and the second scan control signal Gate2 provides low voltage level, and the second reverse scan control signal XGate2 provides high voltage level, and the data signal Data provides low voltage level; with conjunction of FIG. 5, in the initialization stage Initial, the first, the second thin film transistors M1, M2 are activated, and the third, the fifth thin film transistors M3, M5 are deactivated, and the gate of the fourth thin film transistor M4 and the power supply voltage VDD are shorted to accomplish the initialization.

Figure 7:
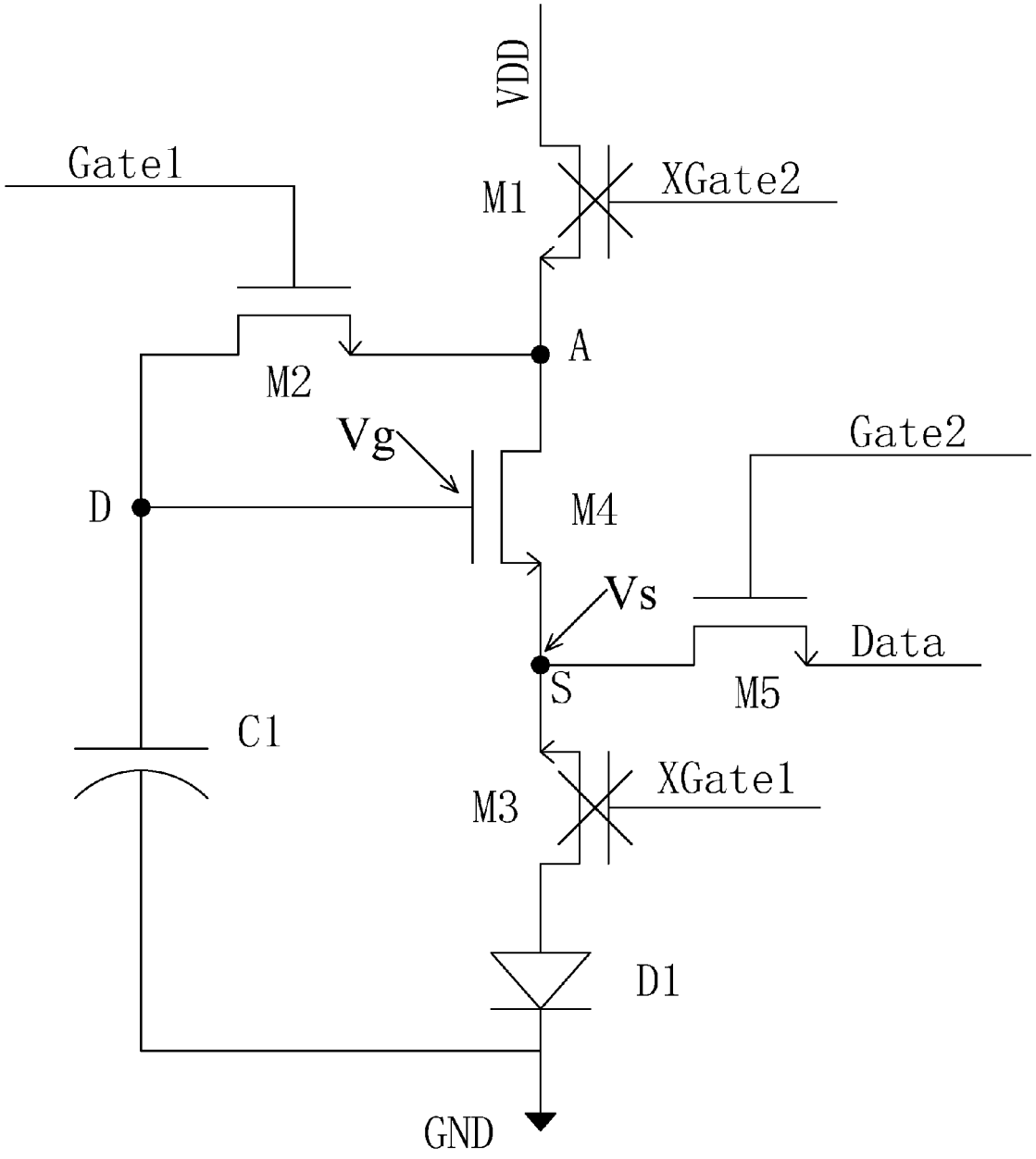
FIG. 7 is a diagram of the step 3 of an AMOLED pixel driving method according to the present invention.

In the threshold voltage programming stage Program, the first scan control signal Gate1 provides high voltage level, and the first reverse scan control signal XGate1 provides low voltage level, and the second scan control signal Gate2 provides high voltage level, and the second reverse scan control signal XGate2 provides low voltage level, and the data signal Data provides high voltage level; with conjunction of FIG. 7, in the threshold voltage programming stage Program, the first, the third thin film transistors M1, M3 are deactivated, and the fifth, the second thin film transistors M5, M2 are activated, and the gate and the source of the fourth thin film transistor M4 starts to discharge, and a gate voltage Vg of the fourth thin film transistor M4 is discharged from the power supply voltage VDD to $V_{Data}+V_{th}$, wherein the $V_{Data}$ is a voltage provided by the data signal Data, and $V_{th}$ is a threshold voltage of the fourth thin film transistor M4, and the threshold voltage of the fourth thin film transistor M4 and the voltage provided by the data signal Data are stored in the capacitor C1, and direct acquirement of the threshold voltage of the fourth thin film transistor M4 and read of the data signal Data are accomplished at the same time.

Figure 8:
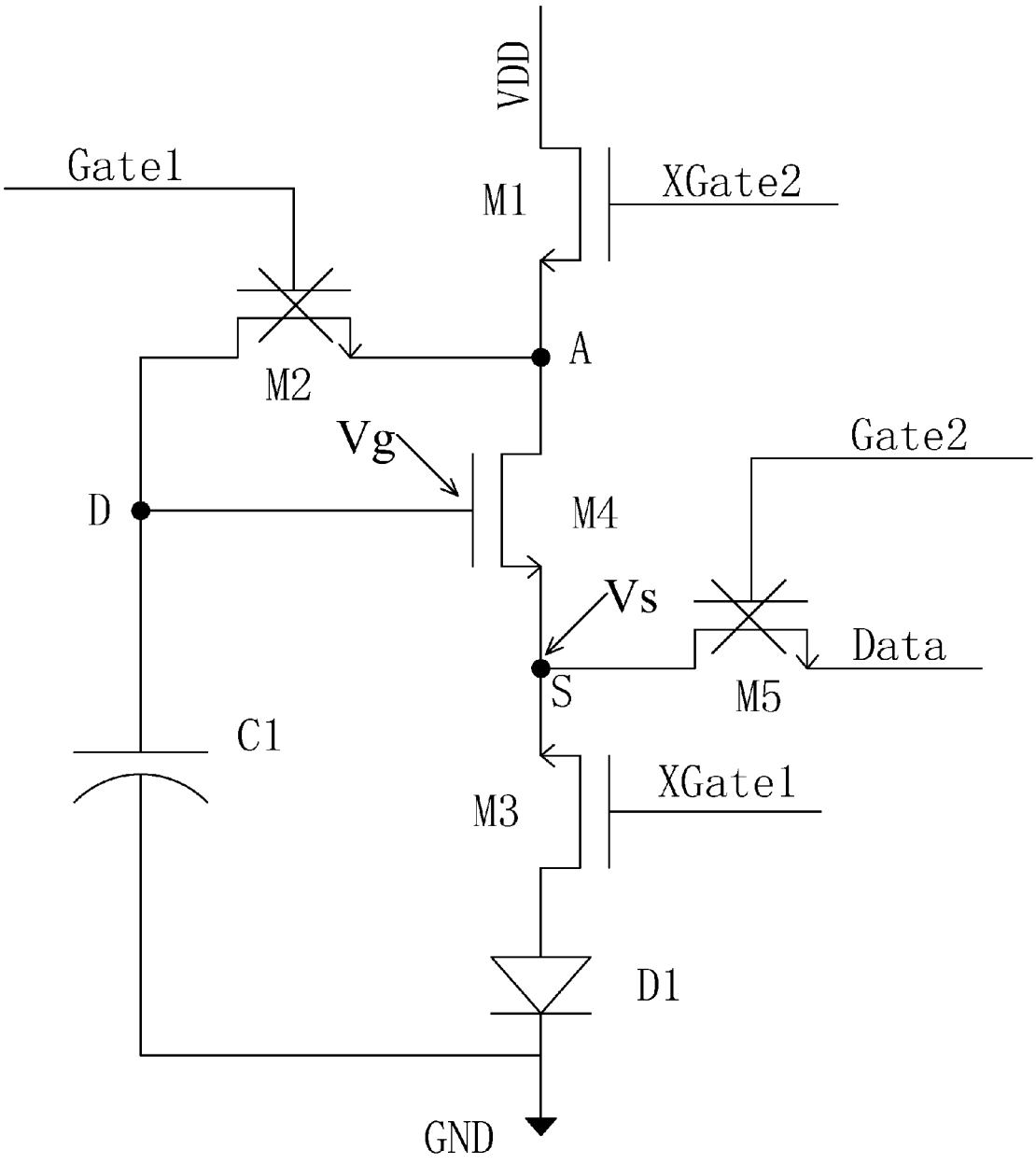
FIG. 8 is a diagram of the step 4 of an AMOLED pixel driving method according to the present invention.

In the drive stage Driving, the first scan control signal Gate1 provides low voltage level, and the first reverse scan control signal XGate1 provides high voltage level, and the second scan control signal Gate2 provides low voltage level, and the second reverse scan control signal XGate2 provides high voltage level, and the data signal Data provides low voltage level; with conjunction of FIG. 8, the fifth, the second thin film transistors M5, M2 are deactivated, and the first, the third thin film transistors M1, M3 are activated, and the capacitor C1 maintains the gate voltage Vg of the fourth thin film transistor M4 at $V_{Data}+V_{th}$, and the organic light emitting diode D1 emits light, and by directly acquiring the threshold voltage of the fourth thin film transistor M4 to implement threshold voltage compensation, and a current flowing through the organic light emitting diode D1 is irrelevant with the threshold voltage of the fourth thin film transistor M4.

The aforesaid AMOLED pixel driving circuit reduces the change of the current flowing through the organic light emitting diode D1 along with the threshold voltage drift by directly acquiring the threshold voltage of the fourth thin film transistor M4, i.e. the drive thin film transistor to implement threshold voltage compensation, to enormously promote the stability of the current and make the panel brightness even; by inputting the data signal Data to the source of the fourth thin film transistor M4, i.e. the drive thin film transistor, the circuit reads the data signal Data at the same time while acquiring the threshold voltage of the drive thin film transistor to combine the procedures of the acquirement of the threshold voltage and the read of the data signal Data as one to promote the working efficiency of the circuit; by setting one end of the capacitor C1 to be coupled to the gate of the fourth thin film transistor M4, i.e. the drive thin film transistor, and the other end to be coupled to the earth GND, the signal input of the capacitor end can be reduced to simplify the required input signal. The manufacture cost of the panel can be lowered and the working efficiency of the circuit can be raised.

Figure 4:
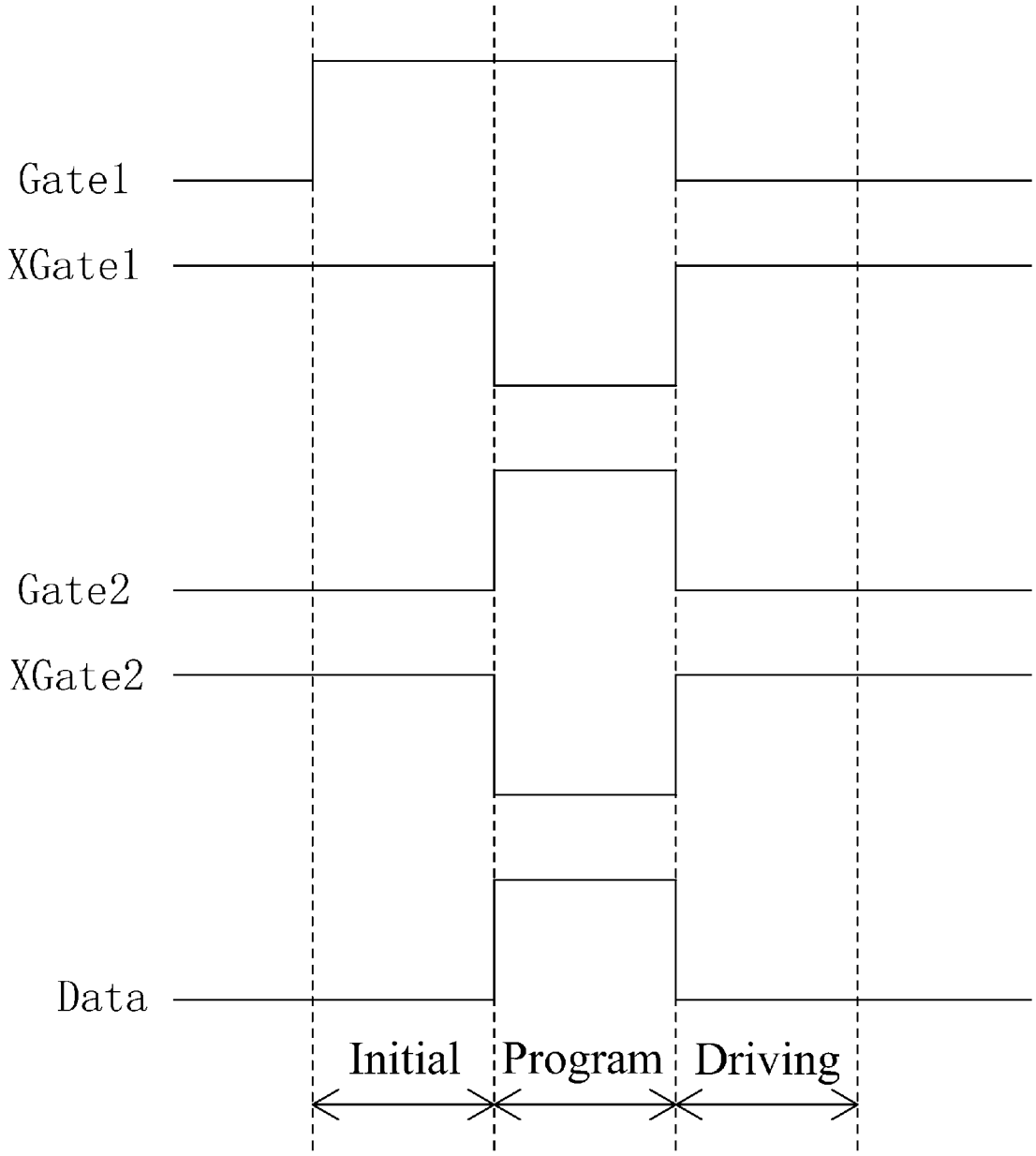
FIG. 4 is a second sequence diagram of an AMOLED pixel driving circuit according to the present invention.

FIG. 4 is a second sequence diagram of an AMOLED pixel driving circuit according to the present invention. The difference of the second sequence from the aforesaid first sequence is that the first reverse scan control signal XGate1 and the second reverse scan control signal XGate2 are the same. In the initialization stage Initial, both the first reverse scan control signal XGate1 and the second reverse scan control signal XGate2 provide high voltage levels. With FIG. 6, the third thin film transistor M3 is activated in the initialization stage Initial, the signals and the circuit working ways in the rest stages are not changed. The repeated description is omitted here. Because the first reverse scan control signal XGate1 and the second reverse scan control signal XGate2 are the same. The two can employ the same signal to simplify the required input signal in advance. The manufacture cost of the panel can be lowered and the stability of the circuit can be raised in advance.

Please refer to FIG. 3, FIG. 5, FIG. 7 and FIG. 8 or FIG. 4, FIG. 6, FIG. 7 and FIG. 8. The present invention further provides an AMOLED pixel driving method, comprising steps of:

step 1, providing the aforesaid AMOLED pixel driving circuit as shown in the aforesaid FIG. 2, and the description of the circuit is not repeated here.

step 2, entering an initialization stage Initial.

Corresponding to the first sequence shown in FIG. 3, in the step 2, the first scan control signal Gate 1 provides high voltage level, and the first reverse scan control signal XGate1 provides low voltage level, and the second scan control signal Gate2 provides low voltage level, and the second reverse scan control signal XGate2 provides high voltage level, and the data signal Data provides low voltage level; with conjunction of FIG. 5, the first, the second thin film transistors M1, M2 are activated, and the third, the fifth thin film transistors M3, M5 are deactivated, and the gate of the fourth thin film transistor M4 and the power supply voltage VDD are shorted to accomplish the initialization. In such condition, the first reverse scan control signal XGate1 provides low voltage level to control the third thin film transistor M3 to be deactivated for avoiding the unnecessary irradiance of the organic light emitting diode D1 in the initialization stage Initial to reduce the electrical power consumption and to promote the lifetime of the organic light emitting diode D1.

Figure 6:
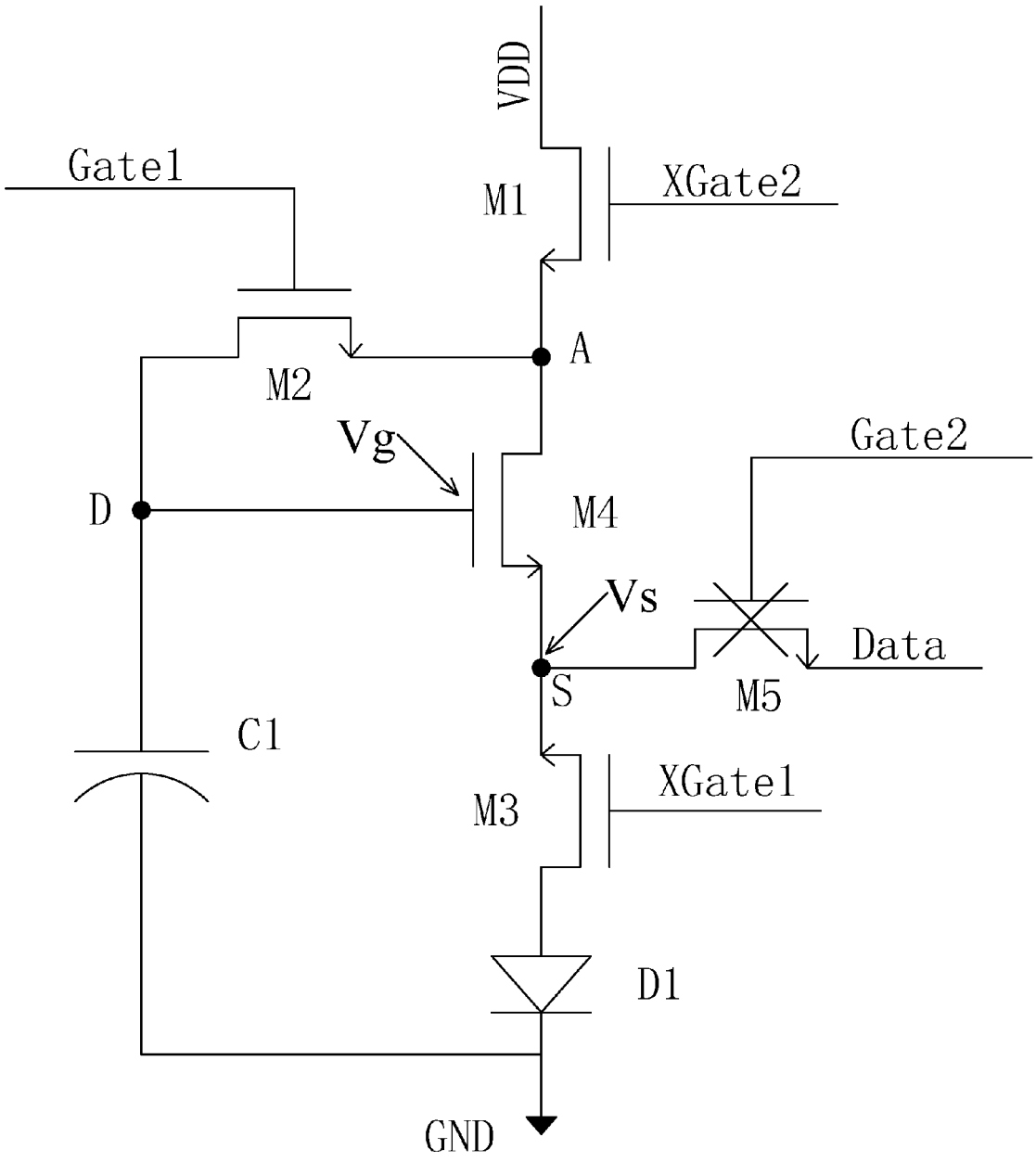
FIG. 6 is a diagram of the step 2 of an AMOLED pixel driving method according to the present invention in accordance with the second sequence.

Alternatively, corresponding to the second sequence shown in FIG. 4, in the step 2, the first scan control signal Gate 1 provides high voltage level, and the first reverse scan control signal XGate1 provides high voltage level, and the second scan control signal Gate2 provides low voltage level, and the second reverse scan control signal XGate2 provides high voltage level, and the data signal Data provides low voltage level; with conjunction of FIG. 6, the first, the second, the third thin film transistors M1, M2, M3 are activated, and only the fifth thin film transistor M5 is deactivated, and the gate of the fourth thin film transistor M4 and the power supply voltage VDD are shorted to accomplish the initialization. Under such circumstance, the first reverse scan control signal XGate1 and the second reverse scan control signal XGate2 are the same. The two can employ the same signal to simplify the required input signal. The manufacture cost of the panel can be lowered and the stability of the circuit can be raised in advance.

step 3, entering a threshold voltage programming stage Program.

As shown in FIG. 3 or FIG. 4, the first scan control signal Gate1 provides high voltage level, and the first reverse scan control signal XGate1 provides low voltage level, and the second scan control signal Gate2 provides high voltage level, and the second reverse scan control signal XGate2 provides low voltage level, and the data signal Data provides high voltage level; with conjunction of FIG. 7, the first, the third thin film transistors M1, M3 are deactivated, and the fifth, the second thin film transistors M5, M2 are activated, and the gate and the source of the fourth thin film transistor M4 starts to discharge, and a gate voltage Vg of the fourth thin film transistor M4 is discharged from the power supply voltage VDD to $V_{Data}+V_{th}$, wherein the $V_{Data}$ is a voltage provided by the data signal Data, and $V_{th}$ is a threshold voltage of the fourth thin film transistor M4, and the threshold voltage of the fourth thin film transistor M4 and the voltage provided by the data signal Data are stored in the capacitor C1, and direct acquirement of the threshold voltage of the fourth thin film transistor M4 and read of the data signal Data are accomplished at the same time.

step 4, entering a drive stage Driving.

As shown in FIG. 3 or FIG. 4, the first scan control signal Gate1 provides low voltage level, and the first reverse scan control signal XGate1 provides high voltage level, and the second scan control signal Gate2 provides low voltage level, and the second reverse scan control signal XGate2 provides high voltage level, and the data signal Data provides low voltage level; the fifth, the second thin film transistors M5, M2 are deactivated, and the first, the third thin film transistors M1, M3 are activated, and the capacitor C1 maintains the gate voltage Vg of the fourth thin film transistor M4 at $V_{Data}+V_{th}$, and the organic light emitting diode D1 emits light, and by directly acquiring the threshold voltage of the fourth thin film transistor M4 to implement threshold voltage compensation, and a current flowing through the organic light emitting diode D1 is irrelevant with the threshold voltage of the fourth thin film transistor M4.

Specifically, in the drive stage Driving, the gate voltage Vg of the fourth thin film transistor M4 is: $Vg=V_{Data}+V_{th}$, and the source voltage Vs is: $Vs=V_{OLED}$, wherein $V_{OLED}$ is the threshold voltage of the organic light emitting diode D1. According to the current property equation of the thin film transistor in this field, the current $I_{OLED}$ flowing through the organic light emitting diode D1 is:

$$I_{OLED} = K(Vg - Vs - V_{th})^2$$
$$= K(V_{Data} + V_{th} - V_{OLED} - V_{th})^2$$
$$= K(V_{Data} - V_{OLED})^2$$

wherein K is the structure parameter of the thin film transistor. As regarding the thin film transistors having the same structure, K are relatively stable.

According to the equation, by directly acquiring the threshold voltage of the fourth thin film transistor M4 to implement compensation to the threshold voltage thereof in the aforesaid step 3, the current flowing through the organic light emitting diode D1 in the step 4 can be irrelevant with the threshold voltage of the fourth thin film transistor M4.

Figure 9:
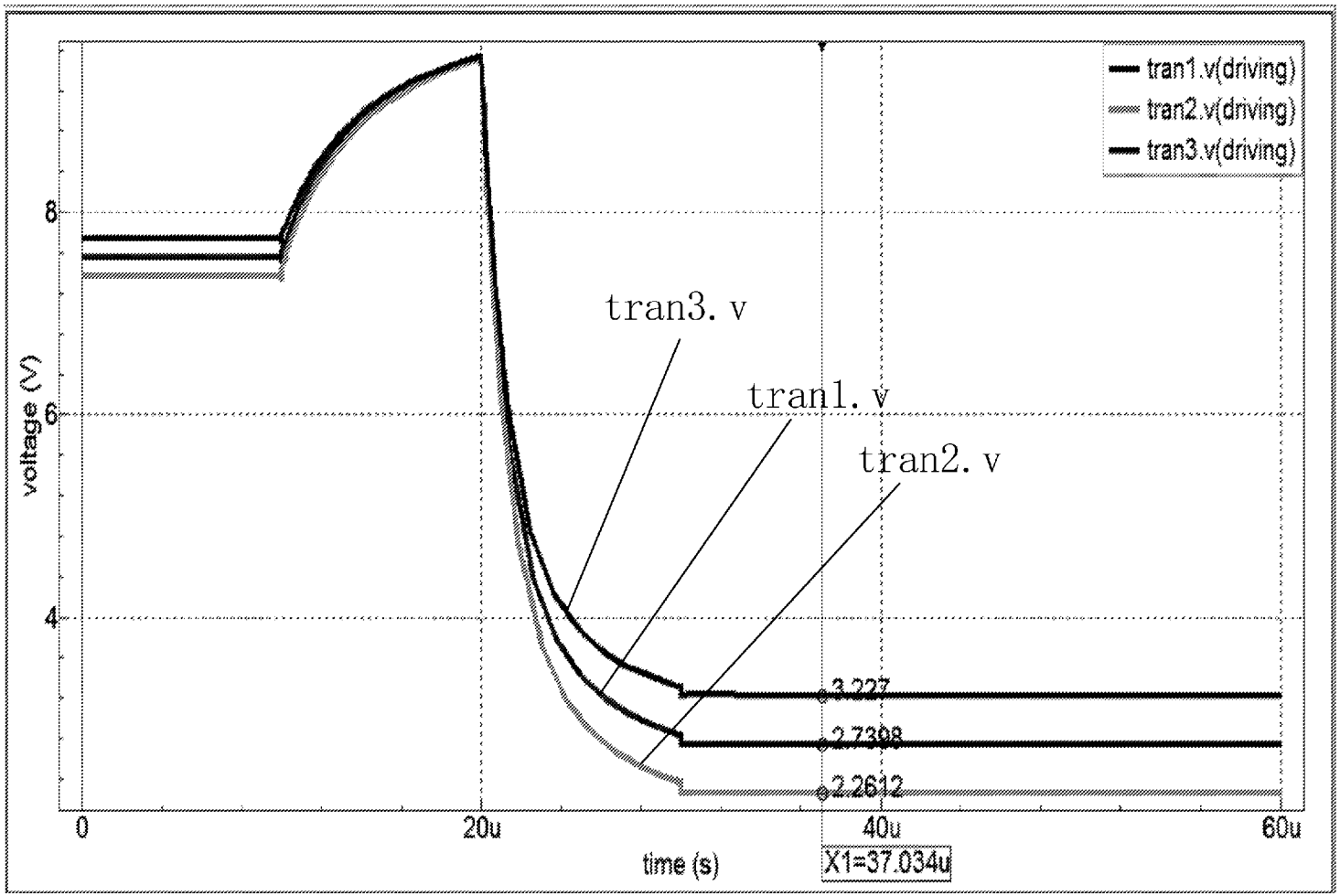
FIG. 9 is a gate voltage curve diagram of a drive thin film transistor as the threshold voltage of the drive thin film transistor of the AMOLED pixel driving circuit according to the present invention drifts ±0.5V.

Please refer to FIG. 9. As the threshold voltage of the fourth thin film transistor M4, i.e. the drive thin film transistor drifts ±0.5V relative to a fixed voltage, the gate voltage of the fourth thin film transistor M4 is also adjusted with ±0.5V, which basically offsets the influence due to the threshold voltage drift to make the brightness of the organic light emitting diode D1 even and thus, improve the display effect of the panel.

Figure 10:
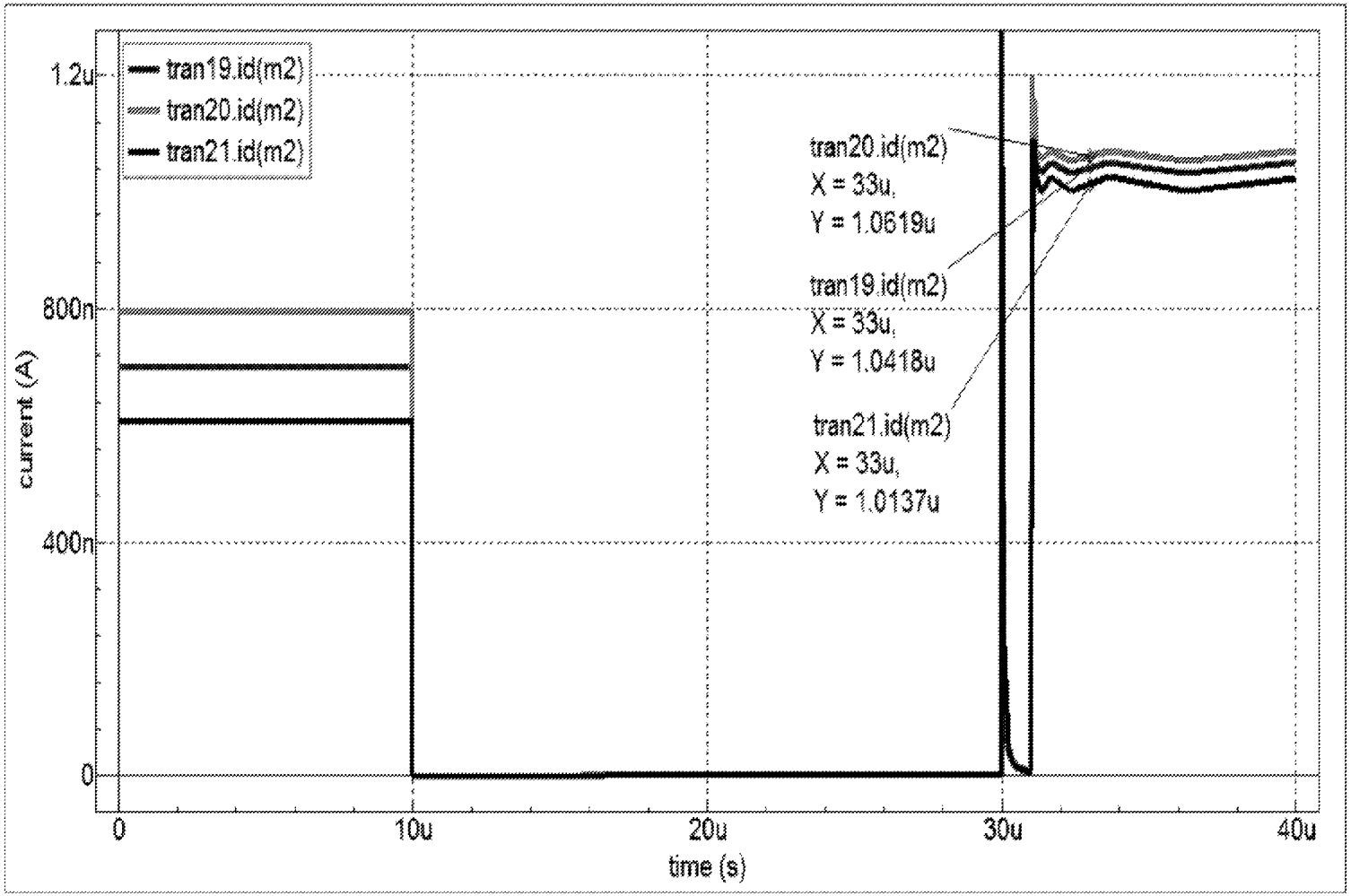
FIG. 10 is a current shift curve diagram of the organic light emitting diode as the AMOLED pixel driving circuit according to the present invention is in high gray scale.
Figure 11:
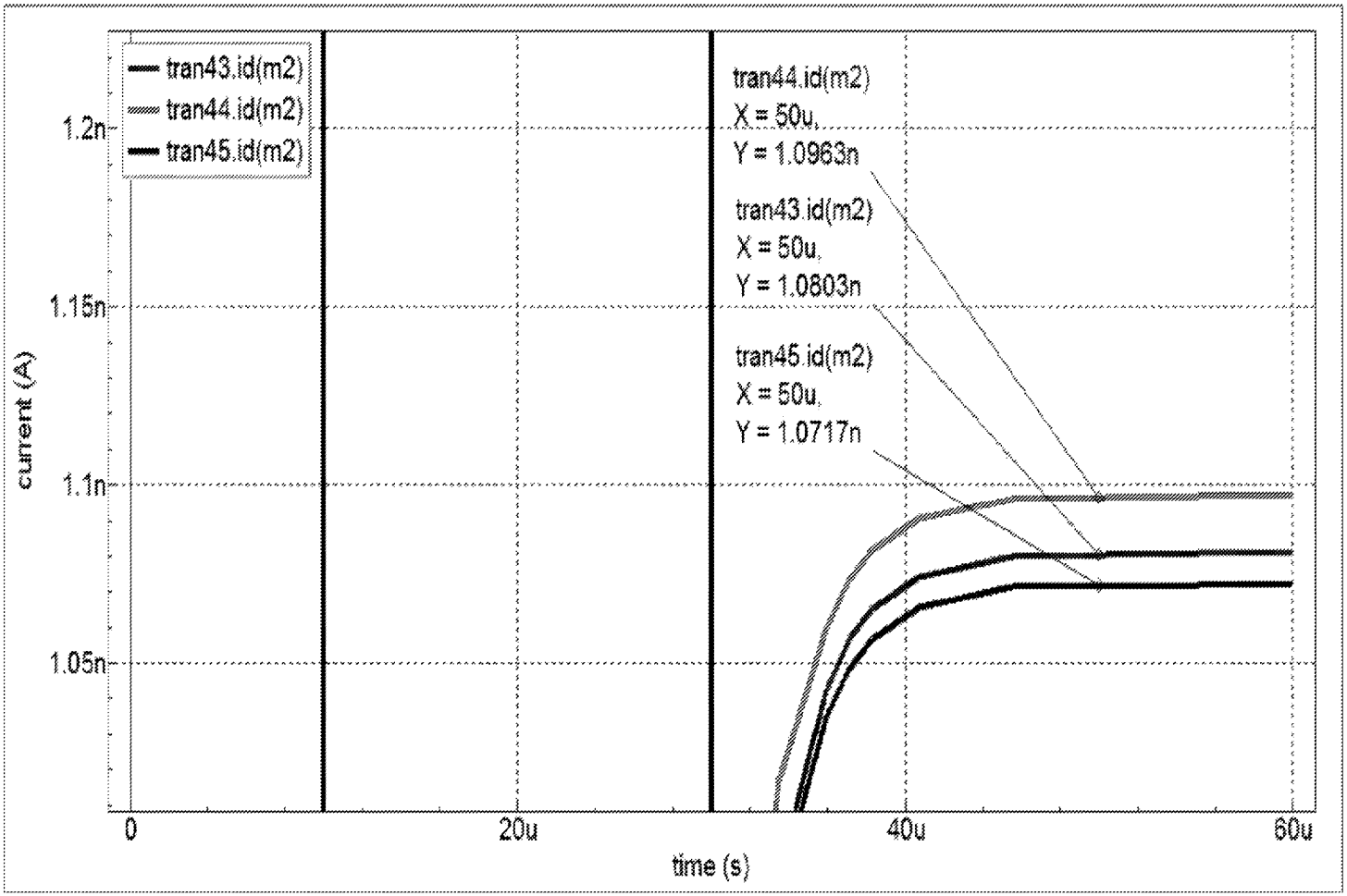
FIG. 11 is a current shift curve diagram of the organic light emitting diode as the AMOLED pixel driving circuit according to the present invention is in low gray scale.

Please refer to FIG. 10, FIG. 11. FIG. 10, FIG. 11 respectively show the current shift conditions of the organic light emitting diode D1 in different gray scales. As shown in FIG. 10, in high gray scale (IOLED=1 uA), the maximum error of the current shift is about 3%; as shown in FIG. 11, in low gray scale (IOLED=1 nA), the maximum error of the current shift is 1.6%. Hence, either in high gray scale or in low gray scale, the AMOLED pixel driving circuit and the pixel driving method of the present invention can effectively compensate the threshold voltage of the drive thin film transistor to stabilize the current flowing through the organic light emitting diode D1 and to ensure that the brightness of the organic light emitting diode D1 is even and the display effect of the panel is improved.

In conclusion, the present invention provides an AMOLED pixel driving circuit and a pixel driving method. By directly acquiring a threshold voltage of the fourth thin film transistor, i.e. the drive thin film transistor to implement threshold voltage compensation and reducing the change of the current flowing through the organic light emitting diode along with the threshold voltage drift to enormously promote the stability of the current and make the panel brightness even; by inputting the data signal to the source of the fourth thin film transistor, i.e. the drive thin film transistor, the circuit reads the data signal at the same time while acquiring the threshold voltage of the drive thin film transistor to combine the procedures of the acquirement of the threshold voltage and the read of the data signal as one to promote the working efficiency of the circuit; by setting one end of the capacitor to be coupled to a gate of the fourth thin film transistor, i.e. the drive thin film transistor, and the other end to be coupled to the earth, the signal input of the capacitor end can be reduced to simplify the required input signal. The manufacture cost of the panel can be lowered and the working efficiency of the circuit can be raised in advance.

Above are only specific embodiments of the present invention, the scope of the present invention is not limited to this, and to any persons who are skilled in the art, change or replacement which is easily derived should be covered by the protected scope of the invention. Thus, the protected scope of the invention should go by the subject claims.

What is claimed is:

1. An AMOLED pixel driving circuit comprises:

a first thin film transistor, a second thin film transistor, a third thin film transistor, a fourth thin film transistor, a fifth thin film transistor, a capacitor and an organic light emitting diode;

a gate of the first thin film transistor is electrically coupled to a second reverse scan control signal, and a drain of the first thin film transistor is electrically coupled to a power supply voltage, and a source of the first thin film transistor is electrically coupled to a first node;

a gate of the second thin film transistor is electrically coupled to a first scan control signal, and a drain of the second thin film transistor is electrically coupled to a second node, and a source of the second thin film transistor is electrically coupled to the first node;

a gate of the third thin film transistor is electrically coupled to a first reverse scan control signal, and a drain of the third thin film transistor is electrically coupled to an anode of the organic light emitting diode and a source of the third thin film transistor is electrically coupled to a third node;

a gate of the fourth thin film transistor is electrically coupled to the second node and one end of the capacitor, and a drain of the fourth thin film transistor is electrically coupled to the first node, and a source of the fourth thin film transistor is electrically coupled to the third node and a drain of the fifth thin film transistor;

a gate of the fifth thin film transistor is electrically coupled to a second scan control signal, and a drain of the fifth thin film transistor is electrically coupled to the third node and the source of the fourth thin film transistor, and a source of the fifth thin film transistor is electrically coupled to a data signal;

said one end of the capacitor is electrically coupled to the second node and the gate of the fourth thin film transistor, and the other end is electrically coupled to an earth;

the anode of the organic light emitting diode is electrically coupled to the drain of the third thin film transistor, and a cathode of the organic light emitting diode is electrically coupled to the earth;

the fourth thin film transistor is a drive thin film transistor; wherein the first scan control signal, the first reverse scan control signal, the second scan control signal, the second reverse scan control signal and the data signal are combined with one another, and correspond to an initialization stage, a threshold voltage programming stage and a drive stage one after another; in the initialization stage, the data signal does not provide $V_{data}$; in the threshold voltage programming stage, the AMOLED pixel driving circuit directly acquires a threshold voltage of the fourth thin film transistor to implement threshold voltage compensation, and acquirement of the threshold voltage and data signal read are accomplished at the same time.

2. The AMOLED pixel driving circuit according to claim 1, wherein all of the first thin film transistor, the second thin film transistor, the third thin film transistor, the fourth thin film transistor and the fifth thin film transistor are Low Temperature Poly-silicon thin film transistors, oxide semiconductor thin film transistors or amorphous silicon thin film transistors.

3. The AMOLED pixel driving circuit according to claim 1, wherein all of the first scan control signal, the first reverse scan control signal, the second scan control signal and the second reverse scan control signal are provided by an external sequence controller.

4. The AMOLED pixel driving circuit according to claim 1, wherein, in the initialization stage, the first scan control signal provides high voltage level, and the first reverse scan control signal provides low voltage level, and the second scan control signal provides low voltage level, and the second reverse scan control signal provides high voltage level, and the data signal provides low voltage level;

in the threshold voltage programming stage, the first scan control signal provides high voltage level, and the first reverse scan control signal provides low voltage level, and the second scan control signal provides high voltage level, and the second reverse scan control signal provides low voltage level, and the data signal provides high voltage level;

in the drive stage, the first scan control signal provides low voltage level, and the first reverse scan control signal provides high voltage level, and the second scan control signal provides low voltage level, and the second reverse scan control signal provides high voltage level, and the data signal provides low voltage level.

5. The AMOLED pixel driving circuit according to claim 1, wherein, in the initialization stage, the first scan control signal provides high voltage level, and the first reverse scan control signal provides high voltage level, and the second scan control signal provides low voltage level, and the second reverse scan control signal provides high voltage level, and the data signal provides low voltage level;

in the threshold voltage programming stage, the first scan control signal provides high voltage level, and the first reverse scan control signal provides low voltage level, and the second scan control signal provides high voltage level, and the second reverse scan control signal provides low voltage level, and the data signal provides high voltage level;

in the drive stage, the first scan control signal provides low voltage level, and the first reverse scan control signal provides high voltage level, and the second scan control signal provides low voltage level, and the second reverse scan control signal provides high voltage level, and the data signal provides low voltage level.

6. The AMOLED pixel driving circuit according to claim 5, wherein the first reverse scan control signal and the second reverse scan control signal are the same.

7. An AMOLED pixel driving circuit comprises: a first thin film transistor, a second thin film transistor, a third thin film transistor, a fourth thin film transistor, a fifth thin film transistor, a capacitor and an organic light emitting diode;

a gate of the first thin film transistor is electrically coupled to a second reverse scan control signal, and a drain of the first thin film transistor is electrically coupled to a power supply voltage, and a source of the first thin film transistor is electrically coupled to a first node;

a gate of the second thin film transistor is electrically coupled to a first scan control signal, and a drain of the second thin film transistor is electrically coupled to a second node, and a source of the second thin film transistor is electrically coupled to the first node;

a gate of the third thin film transistor is electrically coupled to a first reverse scan control signal, and a drain of the third thin film transistor is electrically coupled to an anode of the organic light emitting diode and a source of the third thin film transistor is electrically coupled to a third node;

a gate of the fourth thin film transistor is electrically coupled to the second node and one end of the capacitor, and a drain of the fourth thin film transistor is electrically coupled to the first node, and a source of the fourth thin film transistor is electrically coupled to the third node and a drain of the fifth thin film transistor;

a gate of the fifth thin film transistor is electrically coupled to a second scan control signal, and a drain of the fifth thin film is electrically coupled to the third node and the source of the fourth thin film transistor, and a source of the fifth thin film is electrically coupled to a data signal;

said one end of the capacitor is electrically coupled to the second node and the gate of the fourth thin film transistor, and the other end is electrically coupled to an earth;

the anode of the organic light emitting diode is electrically coupled to the drain of the third thin film transistor, and a cathode of the organic light emitting diode is electrically coupled to the earth;

the fourth thin film transistor is a drive thin film transistor; wherein the first scan control signal, the first reverse scan control signal, the second scan control signal, the second reverse scan control signal and the data signal are combined with one another, and correspond to an initialization stage, a threshold voltage programming stage and a drive stage one after another; in the initialization stage, the data signal does not provide Vdata: in the threshold voltage programming stage, the AMOLED pixel driving circuit directly acquires a threshold voltage of the fourth thin film transistor to implement threshold voltage compensation, and acquirement of the threshold voltage and data signal read are accomplished at the same time;

wherein all of the first thin film transistor, the second thin film transistor, the third thin film transistor, the fourth thin film transistor and the fifth thin film transistor are Low Temperature Poly-silicon thin film transistors, oxide semiconductor thin film transistors or amorphous silicon thin film transistors;

wherein all of the first scan control signal, the first reverse scan control signal, the second scan control signal and the second reverse scan control signal are provided by an external sequence controller.

8. The AMOLED pixel driving circuit according to claim 7, wherein, in the initialization stage, the first scan control signal provides high voltage level, and the first reverse scan control signal provides low voltage level, and the second scan control signal provides low voltage level, and the second reverse scan control signal provides high voltage level, and the data signal provides low voltage level;

in the threshold voltage programming stage, the first scan control signal provides high voltage level, and the first reverse scan control signal provides low voltage level, and the second scan control signal provides high voltage level, and the second reverse scan control signal provides low voltage level, and the data signal provides high voltage level;

in the drive stage, the first scan control signal provides low voltage level, and the first reverse scan control signal provides high voltage level, and the second scan control signal provides low voltage level, and the second reverse scan control signal provides high voltage level, and the data signal provides low voltage level.

9. The AMOLED pixel driving circuit according to claim 7, wherein, in the initialization stage, the first scan control signal provides high voltage level, and the first reverse scan control signal provides high voltage level, and the second scan control signal provides low voltage level, and the second reverse scan control signal provides high voltage level, and the data signal provides low voltage level;

in the threshold voltage programming stage, the first scan control signal provides high voltage level, and the first reverse scan control signal provides low voltage level, and the second scan control signal provides high voltage level, and the second reverse scan control signal provides low voltage level, and the data signal provides high voltage level;

in the drive stage, the first scan control signal provides low voltage level, and the first reverse scan control signal provides high voltage level, and the second scan control signal provides low voltage level, and the second reverse scan control signal provides high voltage level, and the data signal provides low voltage level.

10. The AMOLED pixel driving circuit according to claim 9, wherein the first reverse scan control signal and the second reverse scan control signal are the same.

11. An AMOLED pixel driving method, comprising steps of:

step 1, providing an AMOLED pixel driving circuit;

the AMOLED pixel driving circuit comprises: a first thin film transistor, a second thin film transistor, a third thin film transistor, a fourth thin film transistor, a fifth thin film transistor, a capacitor and an organic light emitting diode;

a gate of the first thin film transistor is electrically coupled to a second reverse scan control signal, and a drain of the first thin film transistor is electrically coupled to a power supply voltage, and a source of the first thin film transistor is electrically coupled to a first node;

a gate of the second thin film transistor is electrically coupled to a first scan control signal, and a drain of the second thin film transistor is electrically coupled to a second node, and a source of the second thin film transistor is electrically coupled to the first node;

a gate of the third thin film transistor is electrically coupled to a first reverse scan control signal, and a drain of the third thin film transistor is electrically coupled to an anode of the organic light emitting diode and a source of the third thin film transistor is electrically coupled to a third node;

a gate of the fourth thin film transistor is electrically coupled to the second node and one end of the capacitor, and a drain of the fourth thin film is electrically coupled to the first node, and a source of the fourth thin film is electrically coupled to the third node and a drain of the fifth thin film transistor;

a gate of the fifth thin film transistor is electrically coupled to a second scan control signal, and a drain of the fifth thin film transistor is electrically coupled to the third node and the source of the fourth thin film transistor, and a source of the fifth thin film transistor is electrically coupled to a data signal;

said one end of the capacitor is electrically coupled to the second node and the gate of the fourth thin film transistor, and the other end is electrically coupled to an earth;

the anode of the organic light emitting diode is electrically coupled to the drain of the third thin film transistor, and a cathode of the organic light emitting diode is electrically coupled to the earth; the fourth thin film transistor is a drive thin film transistor;

step 2, entering an initialization stage;

the first scan control signal provides high voltage level, and the second scan control signal provides low voltage level, and the second reverse scan control signal provides high voltage level, and the data signal provides low voltage level; the first, the second thin film transistors are activated, and the fifth thin film transistor is deactivated and the data signal does not provide $V_{data}$, and the gate of the fourth thin film transistor and the power supply voltage are shorted to accomplish the initialization;

step 3, entering a threshold voltage programming stage;

the first scan control signal provides high voltage level, and the first reverse scan control signal provides low voltage level, and the second scan control signal provides high voltage level, and the second reverse scan control signal provides low voltage level, and the data signal provides high voltage level; the first, the third thin film transistors are deactivated, and the fifth, the second thin film transistors are activated, and the gate and the source of the fourth thin film transistor starts to discharge, and a gate voltage of the fourth thin film transistor is discharged from the power supply voltage to $V_{data}+V_{th}$, wherein the $V_{data}$ is a voltage provided by the data signal, and $V_{th}$ is a threshold voltage of the fourth thin film transistor, and the threshold voltage of the fourth thin film transistor and the voltage provided by the data signal are stored in the capacitor, and direct acquirement of the threshold voltage of the fourth thin film transistor and read of the data signal are accomplished at the same time;

step 4, entering a drive stage;

the first scan control signal provides low voltage level, and the first reverse scan control signal provides high voltage level, and the second scan control signal provides low voltage level, and the second reverse scan control signal provides high voltage level, and the data signal provides low voltage level; the fifth, the second thin film transistors are deactivated, and the first, the third thin film transistors are activated, and the capacitor maintains the gate voltage of the fourth thin film transistor at $V_{data}+V_{th}$, and the organic light emitting diode emits light, and by directly acquiring the threshold voltage of the fourth thin film transistor to implement threshold voltage compensation, and a current flowing through the organic light emitting diode is irrelevant with the threshold voltage of the fourth thin film transistor.

12. The AMOLED pixel driving method according to claim 11, wherein in the step 2, the first reverse scan control signal provides low voltage level, and the third thin film transistor is deactivated.

13. The AMOLED pixel driving method according to claim 11, wherein in the step 2, the first reverse scan control signal provides high voltage level, and the third thin film transistor is activated; the first reverse scan control signal and the second reverse scan control signal are the same.

* * * * *